US006287153B1

(12) United States Patent
Asaoka et al.

(10) Patent No.: US 6,287,153 B1
(45) Date of Patent: Sep. 11, 2001

(54) CABLE CONNECTOR WITH IMPROVED ENGAGEMENT MECHANISM

(75) Inventors: Motoaki Asaoka, Yamato; Hirotaka Tamura, Fujisawa, both of (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/561,527

(22) Filed: Apr. 28, 2000

(30) Foreign Application Priority Data

Apr. 28, 1999 (JP) ..... 11-122424

(51) Int. Cl.[7] ..... H01R 13/04

(52) U.S. Cl. ..... 439/694

(58) Field of Search ..... 439/694, 695, 439/693, 692, 595, 881, 749

(56) References Cited

U.S. PATENT DOCUMENTS 5,676,562 * 10/1997 Fukuda ..... 439/595

* cited by examiner

*Primary Examiner*—Neil Abrams
*Assistant Examiner*—Phuong Dinh
(74) *Attorney, Agent, or Firm*—Stacey E. Caldwell

(57) ABSTRACT

A cable connector which includes an engagement mechanism which prevents the disengagement between the terminal and the housing irrespective of a direction of force applied to the cable. Specifically, the cable connector includes a housing with a terminal mounted therein. An engagement opening portion of the terminal engages an engagement convex portion of a lance provided in the housing. The lance is sandwiched and protected between a support block and a backup wall of the housing. Furthermore, a pair of fitting insert pieces are provided on both sides of a base portion of the terminal and these are configured so as to insert into corresponding fitting insert groove portions provided in the housing.

7 Claims, 3 Drawing Sheets

CABLE CONNECTOR WITH IMPROVED ENGAGEMENT MECHANISM

FIELD OF THE INVENTION

The present invention relates to a cable connector and more particularly to a cable connector provided with an improved engagement mechanism for securing a terminal within its housing and from preventing disengagement of the terminal when forces are applied to the terminal from different directions.

BACKGROUND OF THE INVENTION

Conventionally, in the case where a cable connector comprises a molded housing and a stamped and formed terminal, a terminal locking lance engageable with the terminal is provided within the housing, so that after the terminal is inserted into the housing and the above-described lance is elastically deformed, the lance engages and holds the terminal in a predetermined position within the housing.

In known designs, such as is shown in Japanese Patent Application Laid-Open No. Hei 9-129296 or the like, a backup wall is also formed in the housing at a predetermined position and an engagement piece is provided on the terminal. When the terminal is mounted in the housing, the engagement piece engages the locking lance and the backup wall prevents the lance from being deformed, thereby maintaining the engagement between the terminal and the lance, suppressing the shift or disengagement of the terminal in a direction opposite the insertion direction of the terminal, thus preventing the disengagement between the terminal and the lance.

Although the engagement mechanism between the terminal and the lance according to the above-described prior art is effective for maintaining the engagement between the terminal and the lance in the direction opposite to the insertion direction of the terminal, the mechanism is not always effective for the prevention of the release of engagement caused by a force in a direction perpendicular the terminal insertion direction. Accordingly, in the case where force in the perpendicular direction is applied to the cable (directly connected to the terminal), it has heretofore been difficult to eliminate disengagement between the terminal and the lance and therefore the terminal can be pulled out when force is applied to the cable.

SUMMARY OF THE INVENTION

It is therefore an object of the invention to provide a cable connector having an engagement mechanism between a terminal and a housing which is effective in preventing the terminal from becoming disengaged when a force is applied in a direction perpendicular to the terminal insertion direction or in a direction opposite the terminal insertion direction.

To accomplish this objective, there is provided a cable connector having an improved engagement mechanism for securing a terminal member within a housing comprising:

a support block extending from a bottom surface of the housing having a first insert groove portion formed therein;

a backup wall extending from a bottom surface of the housing generally parallel to the support block having a second insert groove portion formed therein;

a cantilevered deflectable lance formed on the housing and positioned between and generally parallel to the support block and the backup wall; and a terminal base portion of the terminal member having a first fitting insert piece extending in a first direction, and a second fitting insert piece extending in an opposite direction;

wherein when the terminal member is inserted into the housing, the first fitting insert piece is inserted into the first insert groove portion and the second fitting insert piece is inserted into the second insert groove portion to secure the terminal member within the housing.

The engagement mechanism further comprises:

an engagement opening portion formed in the terminal base portion of the terminal member; and an engagement convex portion provided on the deflectable lance, wherein when the terminal member is inserted into the housing, the engagement convex portion is adapted to extend into the engagement opening portion of the terminal member.

As described above, according to the present invention, it is possible to provide a cable connector having an engagement mechanism between a terminal and a housing which is effective for retaining the terminal against forces applied in directions both parallel to and perpendicular to the direction of insertion of the terminal.

BRIEF DESCRIPTION OF THE DRAWINGS

The present invention will be understood more fully from the detailed description given below and from the accompanying drawings of the preferred embodiment of the present invention, which, however, should not be taken to be limitative of the invention, but are for explanation and understanding only, and wherein like reference numerals identify like parts and wherein.

DETAILED DESCRIPTION OF THE PREFERRED EMBODIMENT

Figure 1:
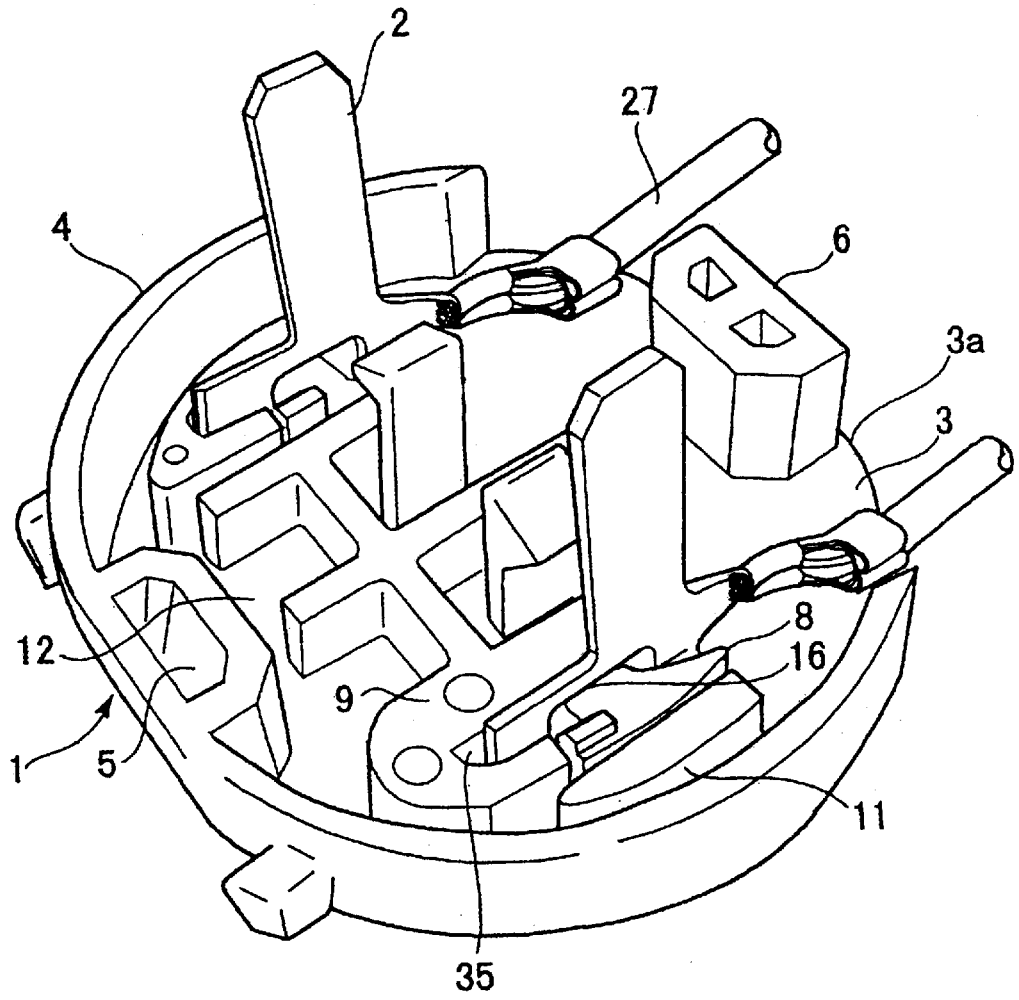
FIG. 1 is a perspective view of a cable connector according to the present invention.
Figure 2:
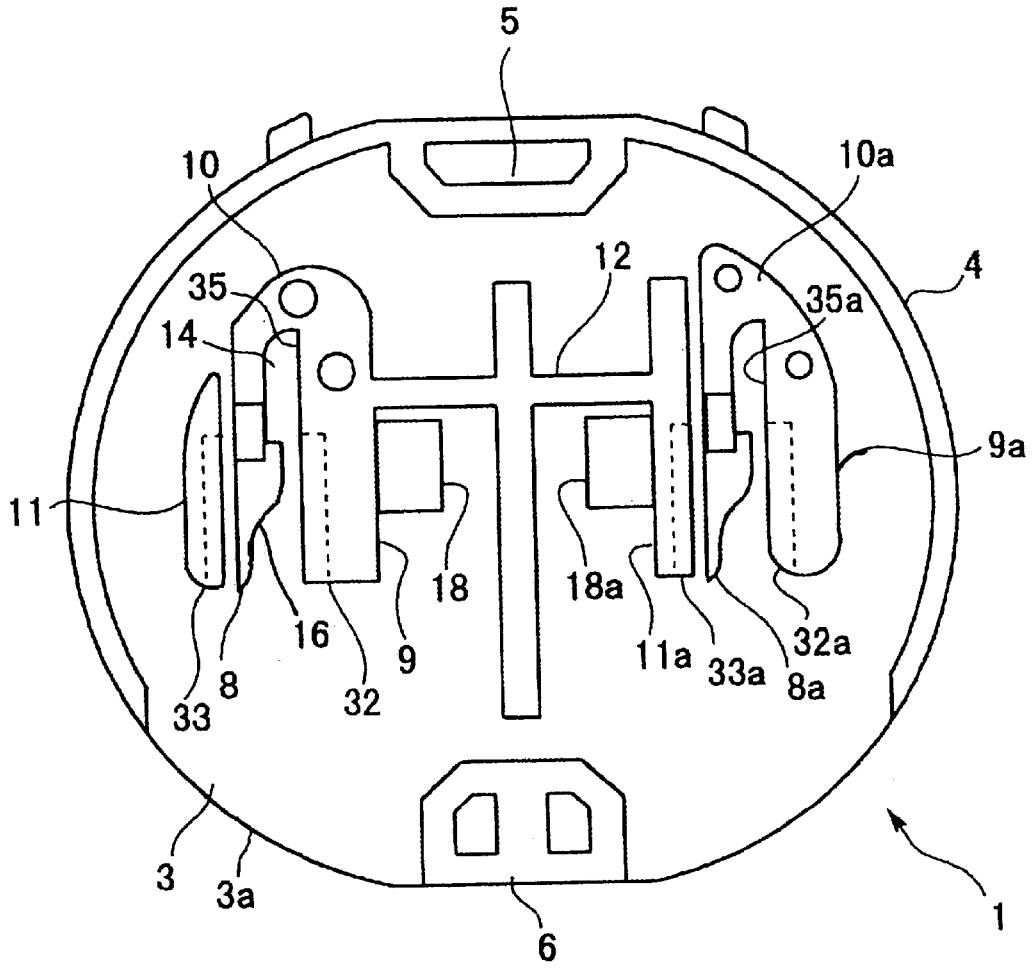
FIG. 2 is a plan view of a housing of the cable connector shown in FIG. 1.

FIG. 1 is a perspective view of a cable connector in accordance with one embodiment of the present invention. As shown in FIGS. 1 and 2, the cable connector comprises a housing 1 which mounts two terminals 2. The engagement mechanism between housing 1 and terminal 2 will be hereinafter explained.

Housing 1 is molded of insulating resin, as shown in FIG. 1. In housing 1, a side wall 4 is provided along a circumferential edge of a housing floor 3 except at side edge 3*a*. A rib 5 having the same height as that of side wall 4 is formed inside and in the vicinity of side wall 4, and a rib 6 is provided in the vicinity of side edge 3*a*.

A cruciform rib 12 having a lower height than that of side wall 4 is provided in the vicinity of a central portion of housing floor 3. Support mechanisms for terminal 2 are formed on the right and left sides of this cruciform rib 12 and comprise a pair of support blocks 9 and 9*a*, lances 8 and 8*a* and backup walls 11 and 11*a*.

Support block 9 is integrally formed on one side of cruciform rib 12 as shown in FIG. 2. Lance 8 is cantilevered and extends from a curved continuous portion 10 which is integral with support block 9. Lance 8 extends substantially parallel to support block 9 toward side edge 3*a*. A support wall 35 is formed on a side surface of support block 9. Backup wall 11 faces support wall 35 through the lance 8.

Backup wall 11*a* continues past cruciform rib 12. Lance 8*a* extends substantially parallel to backup wall 11*a* toward side edge 3*a*. Support wall 35*a* of support block 9*a* faces backup wall 11*a* through lance 8*a*. Lance 8*a* is cantilevered and extends from curved continuous portion 10 which is integral with support block 9*a*.

The detailed explanation will be made mainly with reference to the structure on the left of cruciform rib 12 (as shown in FIG. 2). However, the explanation may be equally applied to the structure on the right side of cruciform rib 12. Either lance 8 is elastically deflectable in a direction away from support block 9 about a pivot point at or near a distal end of continuous portion 10. The lance may be formed to be elastically deflectable integrally with any one or all of the floor of said housing, the backup wall or the support wall. Lance 8 is configured to form a gap-like terminal mounting portion 14 together with support block 9. An engagement convex portion 16 is provided on the side wall of lance 8 facing support block 9.

Figure 4:
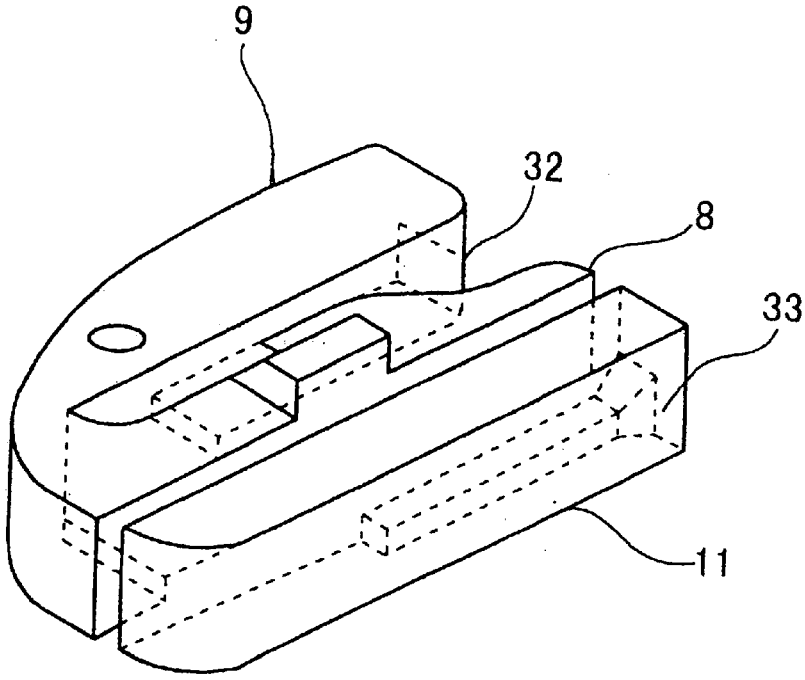
FIG. 4 is a partially enlarged perspective view of an engagement portion of the housing of the cable connector shown in FIG. 1.

A pair of fitting insert groove portions 32 and 33 are formed parallel and facing each other at the interface between support block 9 and housing floor 3 and at the interface between backup wall 11 and housing floor 3. FIG. 4 is an enlarged view of support block 9, lance 8, backup wall 11 and fitting insert groove portions 32 and 33.

A pair of latches 18 and 18*a* are formed on the right and left sides of cruciform rib 12 with a height exceeding that of side wall 4. The latches are used to engage the cable connector with another mechanism such as a motor body (not shown).

Figure 3:
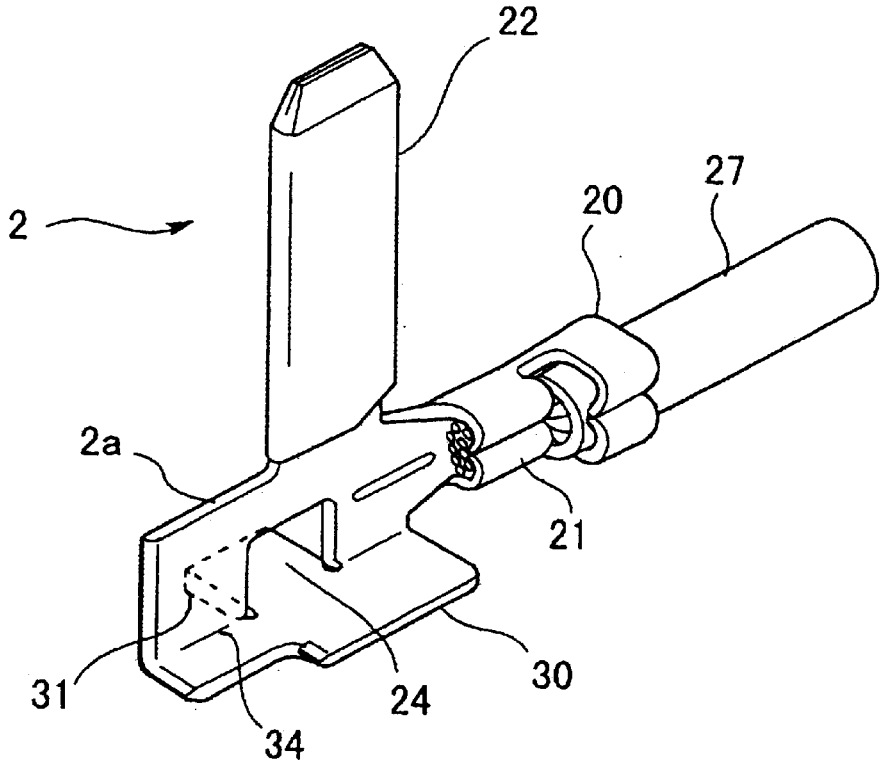
FIG. 3 is a perspective view of a terminal of the cable connector shown in FIG. 1.

Terminal 2 as shown in FIG. 3 is stamped and formed from sheet metal material and includes a contact piece 22 adapted for electrically contacting a conductive portion of the mating mechanism. The lower portion of terminal 2 will be referred to as a terminal base portion 2*a*. The lower end portion of terminal base portion 2*a* is formed into a fitting insert piece 30 bent substantially at a right angle relative to the terminal base portion 2*a*. An engagement opening portion 24 is provided in the central vicinity of the bent portion of terminal base portion 2*a*. The material cut to provide the opening is bent substantially at a right angle relative to base portion 2*a* to form a fitting insert piece 31. Accordingly, the fitting insert piece 30 and the fitting insert piece 31 form a surface substantially perpendicular to contact piece 22 on both sides of terminal base portion 2*a*.

Two different insulated wire clamp pieces are provided on a rear end portion of terminal base portion 2*a*. Clamp piece 21 (or wire barrel) pressingly contacts the conductor of insulated wire 27 and clamp piece 20 (or insulation barrel) pressingly contacts the insulation of the wire. Both clamp pieces are formed in a U-shape or a J-shape in cross-section to provide adequate electrical and mechanical connections, respectively. FIG. 3 shows terminal 2 with both clamp pieces in their terminated state to insulated wire 27.

Terminal 2 is inserted into housing 1 in a terminal insertion direction through side edge 3*a* of housing floor 3 of housing 1. During insertion, fitting insert pieces 30 and 31 of terminal 2 are inserted into fitting insert groove 32 and 33 of housing 1 and together function as guide means for inserting the terminal into the housing. As the terminal is further inserted, contact piece 22 and terminal base portion 2*a* are moved into gap-like terminal mounting portion 14 between lance 8 and support block 9. Since engagement convex portion 16 is provided on lance 8, engagement convex portion 16 is pushed laterally due to the thickness of terminal base portion 2*a* and lance 8 is temporarily elastically deflected in the direction away from support block 9. When the terminal is still further inserted, engagement opening portion 24 in terminal base portion 2*a* reaches a position corresponding to engagement convex portion 16. The convex portion 16 engages opening portion 24. In this position, lance 8 is returned back from the deflected condition to thereby complete the engagement.

When engagement convex portion 16 is engaged within engagement opening portion 24, the engagement between lance 8 and terminal 2 is secure when forces are applied from different directions. That is, when insulated wire 27 is pulled in either a direction opposite the terminal insertion direction or in a direction perpendicular to the terminal insertion direction, the terminal remains secure within the housing and there is little chance of disengagement between the terminal and the housing. Since support block 9 and backup wall 11 face each other and sandwich lance 8 to protect lance 8, lance 8 can not be deflected more than the gap between support block 9 and backup wall 11, thus providing an anti-overstress feature for lance 8. Therefore this structure provides assurance that the elasticity of lance 8 is not overstressed and broken.

The engagement between engagement convex portion 16 and engagement opening portion 24 of contact piece 22 is released by deflecting lance 8, thus allowing terminal 2 to be removed in a direction opposite the terminal insertion direction.

In the illustrated embodiment, the engagement mechanism between the terminal and the housing is effected by both the engagement between fitting groove portions 32 and 33 and fitting insert pieces 30 and 31 and the engagement between engagement convex portion 16 and engagement opening portion 24. However, the engagement mechanism can be effective in certain applications and prevent the disengagement between the terminal and the housing by either engagement arrangement alone. That is the engagement between engagement convex portion 16 and engagement opening portion 24 can be an effective engagement mechanism alone where the disengagement forces between the terminal and the housing correspond to the particular application. Similarly, in applications where the lance itself has a minimum mechanical strength, it is possible to use a cable connector provided only with the engagement mechanism consisting of engagement convex portion 16 and engagement opening portion 24.

Furthermore, although a through-opening is shown for engagement opening portion 24, it is possible to use a simple recess for receiving engagement convex portion 16. Also, the shape of the opening need not be formed into a square opening as shown in the figures. It is possible to use a U-shaped or other cutaway since excess forces are not generally applied to the terminal in the insertion direction. This type of structure would function well in most applications where forces are applied mainly in the direction opposite or perpendicular to the terminal insertion direction.

Although the present invention has been illustrated and described with respect to the exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the features set out in the appended claims.

We claim:

1. A cable connector with an improved engagement mechanism for securing a terminal member within a housing, the cable connector comprising:

an insulative housing having a floor and including a support block extending from the floor of the housing and having a first insert groove portion formed therein, a backup wall extending from the floor of the housing generally parallel to the support block and having a second insert groove portion formed therein, and a cantilevered deflectable lance formed on the housing and positioned between and generally parallel to the support block and the backup wall; and at least one terminal member mounted in the housing including a terminal base portion having a first fitting insert piece extending in a first direction and a second fitting insert piece extending in an opposite direction;

wherein the first fitting insert piece of the terminal member is located within the first insert groove portion and the second fitting insert piece is located within the second insert groove portion to hold the terminal member securely within the housing.

2. The cable connector as set forth in claim 1 wherein the housing further comprises a side wall provided along an edge of the housing except at a side edge thereof.

3. The cable connector as set forth in claim 1 wherein the deflectable lance portion includes an engagement convex portion which is deflected by the terminal base portion during insertion of the terminal member into the housing.

4. The cable connector as set forth in claim 3 wherein the terminal base portion of the terminal member has an engagement opening portion formed therethrough and the engagement convex portion of the lance extends into the engagement opening portion of the terminal member to further hold the terminal member securely within the housing.

5. A cable connector with an improved engagement mechanism for securing a terminal within a housing, the cable connector comprising:

an insulative housing having a floor, a support block and a backup wall extending from the floor, and including a cantilevered deflectable lance positioned between the support block and the backup wall, the lance having an engagement convex portion proximate an end thereof; and at least one terminal mounted in the housing including a terminal base portion with an engagement opening portion formed therein, wherein the engagement convex portion is adapted to extend into the engagement opening portion of the terminal to secure the terminal within the housing.

6. The cable connector as set forth in claim 5 wherein the support block includes a first insert groove portion formed therein, the backup wall includes a second insert groove portion formed therein, and the terminal base portion includes a first fitting insert piece extending in a first direction and a second fitting insert piece extending in an opposite direction such that the first fitting insert piece of the terminal is located within the first insert groove portion and the second fitting insert piece is located within the second insert groove portion to hold the terminal member securely within the housing.

7. The cable connector as set forth in claim 6 wherein the first and second fitting insert groove portions are formed parallel and facing each other and are formed at the interface between the support block and the housing floor, and at the interface between the backup wall and the housing floor, respectively.

* * * * *